US008387316B2

(12) United States Patent
Garza

(10) Patent No.: US 8,387,316 B2
(45) Date of Patent: Mar. 5, 2013

(54) ASSEMBLY SYSTEM FOR INSULATING FLOORS

(76) Inventor: Jose Leon Garza, Mexico (MX)

( * ) Notice: Subject to any disclaimer, the term of this patent is extended or adjusted under 35 U.S.C. 154(b) by 113 days.

(21) Appl. No.: 12/670,005

(22) PCT Filed: Mar. 4, 2008

(86) PCT No.: PCT/MX2008/000036

§ 371 (c)(1),
(2), (4) Date: May 10, 2010

(87) PCT Pub. No.: WO2009/110776

PCT Pub. Date: Sep. 11, 2009

(65) Prior Publication Data

US 2010/0281795 A1 Nov. 11, 2010

(51) Int. Cl.
*E04B 5/23* (2006.01)
*E04B 5/21* (2006.01)

(52) U.S. Cl. ..... 52/126.1; 52/126.5; 52/126.6; 52/263; 52/220.5

(58) Field of Classification Search ..... 52/126.1, 52/126.5, 126.6, 582.1, 263, 220.2, 220.5, 52/220.6

See application file for complete search history.

(56) References Cited

U.S. PATENT DOCUMENTS 2,201,129 A * 5/1940 Weiland ..... 52/509
3,096,695 A * 7/1963 Reinhardt ..... 404/43
3,811,237 A * 5/1974 Bettinger ..... 52/126.6
3,961,453 A * 6/1976 Couwenbergs ..... 52/509
4,171,625 A 10/1979 Johnson
4,558,544 A * 12/1985 Albrecht et al. ..... 52/126.6
4,593,499 A * 6/1986 Kobayashi et al. ..... 52/126.6
4,719,727 A * 1/1988 Cooper et al. ..... 52/126.6
4,835,924 A * 6/1989 Blacklin et al. ..... 52/263
4,996,804 A * 3/1991 Naka et al. ..... 52/126.6
5,013,176 A * 5/1991 Orbom ..... 403/171
5,031,369 A * 7/1991 Kobayashi et al. ..... 52/126.6
5,363,560 A * 11/1994 Makow ..... 33/527
5,400,554 A * 3/1995 Lo ..... 52/126.5
5,403,637 A * 4/1995 Pickard et al. ..... 428/44
5,459,968 A * 10/1995 Jin ..... 52/126.6
5,479,745 A * 1/1996 Kawai et al. ..... 52/126.6
5,675,950 A * 10/1997 Schilham ..... 52/263
5,749,188 A * 5/1998 Belbenoit ..... 52/263

(Continued)

FOREIGN PATENT DOCUMENTS

EP 1808086 A2 7/2007

*Primary Examiner* — Phi Dieu Tran A

(74) *Attorney, Agent, or Firm* — Mark Miller; Jackson Walker LLP

(57) ABSTRACT

The invention relates to an assembly system used to form insulating floors, in which two types of elements are coupled to one another, namely: hollow prismatic floor modules (100) including one face (110) which forms the load-supporting useful surface and containing cylindrical elements (160, 162, 164, 166) for receiving coupling elements (200); and coupling elements (200) comprising cross-shaped elements with U-sections forming the arms thereof, intended to receive the vertical faces (140, 142, 144, 146) of the floor modules (100), and posts (230) which are coupled to the corresponding hollow cylindrical elements (160, 162, 164, 166) of the floor modules (100) to be joined. The geometric configuration of the modules (100) and the coupling elements (200) ensure that the load on the assembled floor is transmitted to the ground through the vertical walls (140, 142, 144, 146) of the prismatic body (100), the coupling elements (200) and a central cylindrical load body (170). The modules (100) can be made from insulating material and be provided with a non-slip useful surface.

13 Claims, 11 Drawing Sheets

U.S. PATENT DOCUMENTS

| | | | | |
|---|---|---|---|---|
| 5,904,015 | A * | 5/1999 | Chen | 52/220.2 |
| 6,370,831 | B1 * | 4/2002 | Marshall et al. | 52/263 |
| 6,702,515 | B1 * | 3/2004 | Frederiksen | 404/41 |
| 7,140,156 | B1 * | 11/2006 | Lowe et al. | 52/263 |
| 7,386,955 | B1 * | 6/2008 | Repasky | 52/126.6 |
| 7,428,802 | B2 * | 9/2008 | Fukura et al. | 52/506.05 |
| 7,574,812 | B2 * | 8/2009 | Dabrowski et al. | 33/333 |
| 8,020,783 | B2 * | 9/2011 | Backman, Jr. | 237/69 |
| 2003/0089049 | A1 * | 5/2003 | Scissom et al. | 52/126.1 |
| 2004/0099005 | A1 | 5/2004 | Newman | |
| 2006/0070393 | A1 | 4/2006 | Muscato | |
| 2006/0283196 | A1 | 12/2006 | Rosenbaum | |

* cited by examiner

ASSEMBLY SYSTEM FOR INSULATING FLOORS

TECHNICAL FIELD

The invention relates to an assembly system used to form insulating floors, designed to be assembled 'in situ' directly on the ground or an existing floor, and specially to assemblable floors offering an insulating surface for handling of equipment and electrical systems.

BACKGROUND OF THE INVENTION

There are multiple examples in literature related to connectable elements, especially blocks designed to form constructions and double floors, for example. The following are some of them.

The U.S. Pat. No. 6,645,033 (Thomsen, 2003} assigned to Interlego, is an example of the developments by this company in the area of assemblable construction toys, most of which show a similar structure and operation. In this patent, construction elements are described that include a body in the form of box that has a surface with upper and lower sides and a plurality of faces that extend towards underneath this surface, as well as a plurality of projections for connection that extend downwards until a distance smaller than the height of the walls, that are coupled with projections on the upper surface of another similar element, where the projections have an equal height to the difference between the walls and the projections for connection; this idea has been developed from designs like the shown one in the U.S. Pat. No. 3,570,170 (Kishi, 1971).

In an alternative proposed in the U.S. Pat. No. 5,848,927 (Frederiksen, 1998), the coupling between the upper and lower pieces is obtained when modifying the form of the projection in the lower piece to a hemisphere in order that it fits to the interior of a hollow cylindrical projection towards underneath of the upper piece.

Although the previous examples offer alternatives for the coupling of units one on another one, for the purposes of the invention it is necessary to consider the connection side to side of individual elements. In this way, the U.S. Pat. No. 6,050,044 (McIntosh, 2000) describes a block of construction with lateral male/female joints of the "dovetail" type. The U.S. Pat. No. 4,728,310 (Valtolina et al, 1988) offers a lateral connection by means of interconnection elements that are coupled between parallel and perpendicular ribs of relatively flat panels.

All these references are limited applications in the scope of the construction toys, reason why their dimensions allow that a connection by superposition of minimal areas between blocks is sufficient to maintain the integrity of the connected set. In the scope of the industrial applications, we have the following examples of assemblable floors:

The U.S. Pat. No. 6,889,631 (McGregor, 2005) describes modules for the formation of floors for cattle, where the individual modules are mounted on rails on the ground; the panels, made of metal and plastic, offer in their sides, a series of projections and hollows (male/female) to be coupled to each other, but always the joint line must remain on preset rails. This is the same basic idea of panels described in the U.S. Pat. No. 4,953,501 (Moreau, 1990), or in U.S. Pat. No. 6,647,684 (Gank, 2003) where a frame with male/female pieces is formed, and panels are confined in its interior which offer the surface of useful load. Many later developments are based on this idea of the substructure for panels support, and it is the technique mainly used for the construction of "double" floors for uses in computer rooms, for example, in which the space between both surfaces, the ground and the double floor, is used to confine electrical or data transmission systems.

Alternatively to the necessity of a previous substructure for the support of the useful surface, the U.S. Pat. No. 4,198,795 (Barnidge, 1980) proposes the use of self-supported individual modules, with elements for coupling in the vertical sidewalls. One more alternative it is considered in the U.S. Pat. No. 4,648,592 (Harinishi, 1987), where it is described a structure of floor for gymnastics that includes a panel, a substructure fixed to the ground and a plurality of intermodular I-shaped supports where the ends form U-shaped channels which receive the lateral ends of the modular panels.

Between the most recent developments, it is worth to mention the United States patent application No. US2004/0258870 (Oakey et al, 2004) describing a reconfigurable floor and the method of assembling of the same, that allows to the elaboration of a variety of designs and the easy assembly/disassembly for its reuse.

Finally, there is a Mexican patent application PA/a/2006/003673 (Leon, 2006), the teachings of which are incorporated by reference, wherein a solution to the problem of installation of assemblable floors for diverse uses is described, based in two basic elements: a low-height tile of polygonal shape, preferably square-based, and a union element between pairs of tiles; the union is made by means of projections in the union element, fitted in corresponding hollows in the lower face of the body of the prismatic tile, nevertheless, this alternative have problems to guarantee a good isolation between the ground and the surface of the assembled floor, mainly due to the space between two contiguous tiles, that can serve as "bridge" for an electrical charge.

OBJECTS OF THE INVENTION

In the view of the limitations that until now offer the proposed developments in the prior art, it is an object of the present invention, to provide a floor or insulating platform that can be assembled 'in situ' on the ground or floor.

It is another object of the present invention, to provide a floor or insulating assemblable platform made up of floor modules and union modules between the floor modules, whose positioning is simple.

It is another object of the present invention, to provide a floor or insulating assemblable platform that guarantees an improved electrical isolation between the ground underneath and any object or person located above.

It is still another object of the invention, to provide a floor or insulating assemblable platform whose upper surface, in contact with a person or user, is non-slippery.

It is still another object of the present invention, to provide a floor or insulating assemblable platform that offers aesthetic finishing once it has been assembled in its place.

Still another object of the present invention is to provide a floor or insulating assemblable platform whose elements allow their easy disassembling for reuse in another environment.

Some objects and advantages of the present invention will become evident in view of the description that follows that is accompanied by a series of figures for the preferred modalities of the invention, which must be understood as elaborated with illustrative and non-limiting purposes of the teachings of the invention.

BRIEF DESCRIPTION OF THE INVENTION

The assembly system used to form insulating floors and the resulting product, matter of the present invention, are based on the connection between two types of elements:

a) floor modules, with form of hollow square-base prism, one of whose faces constitutes the useful surface for load or people support; with vertical walls in its perimeter that projects in the direction towards underneath the face with the useful surface; a load body, cylindrical and hollow that extends from the central point of the lower surface of the useful face towards the lower plane of the prism, determined by the lower edges of the vertical walls; and a plurality of cylindrical projections that extend from the inner surface of the useful face, with a section destined to be inserted in corresponding subjection elements in the union elements of the floor modules and another section of diameter slightly greater that works like limit for the insertion, located preferably in the center of the length of these vertical walls, next to the vertical walls, and b) union elements to join the floor modules, each one consisting of an element in the form of a cross, with arms showing a "U"-shaped profile, to allow the pass through and retention of the walls of the floor modules, with the ends of the "U" being closer to each other than the distance between its bases so that they exert pressure against any object that is inserted among them, having two of the contiguous arms, a recess in the outside of its vertical faces in the zone next to the end, and both arms opposed, having a corresponding zone reduced in the vertical faces, to the interior of the "U" and in the zone next to the end, complementing itself these corresponding recesses of two union elements so that when being coupled to each other, the center to center length of said two union elements corresponds with the length of the face of the floor module, and in such a way that a pair of subjection elements located on the outer vertical surface in the arms of constant external thickness, locate at the center of the length of the face of the floor module so that they correspond with the cylindrical projections of it and they are coupled to them when allowing the insertion inside the subjection elements, of these cylindrical projections.

the height of the union elements is so, that they can be placed perfectly below the floor modules, so that the vertical cylindrical posts of the floor module can slide to the interior of and fitting themselves in, the cylindrical and hollow subjection elements of the union elements; the post corresponding to the vertical face of the floor module that is tried to join it is introduced in the hollow cylinder of the respective union element, making the same with the vertical face of a second floor module to join with the first, putting in contact the corresponding faces of both floor modules and inserting them between the arms of the "U" of the union element, which press them to each other, and where when being coupled the cylindrical projections of each floor module in the respective subjection elements of the union elements, a securing of the three bodies to each other it is formed.

In order to make an insulating floor in accordance with the invention, it is necessary the use of several floor modules, so many as they are necessary to cover the objective surface, and so many union elements as they are necessary to join and to hold these floor modules; it must be observed that the union elements offer a pair of arms with a recess in the outer faces, in a zone near the end of the arms, whereas other two arms have a corresponding recess in the inner faces; these recesses are coupled to each other so that the arm with the internal recess covers and complements to the arm with the outer recess, so to connect several floor modules and union elements, it is required to maintain an order of construction, so that each new union element added to the set, on the one hand covers with its arms with internal recesses to the arms with external recesses of a union element already placed, and on the other hand, this new added union element offers two arms with outer recess to be coupling of the following union element.

It must be observed also that the central cylindrical projection of the floor module, has dimensions such that protrude from the plane of the floor module in a measurement that is equivalent to the thickness of the base of the union element, in such way that when several floor modules and union elements are coupled, these central cylindrical projections reach the lower plane of the set of assembled floor and therefore they allow to a strongpoint to the useful surface of each floor module, allowing a great lifting capacity and resistance.

Due to the geometrical configuration of the modules and the union elements, the load on the assemblable floor insulator is transmitted to the lower floor through the vertical walls towards the base of the union elements, and the body of central cylindrical load.

BRIEF DESCRIPTION OF THE FIGURES

For a better understanding of the advantages of the system of the invention, a series of drawings and figures trying to show, in an illustrative way, the characteristics of a preferred embodiment of the system, without trying to be limiting of the same.

FIG. 14 *b* is a simple perspective view of a section of the assembled floor using a full height embodiment of the union element.

The FIG. 14 *c* is a simple perspective view of a section of the assembled floor using a low height embodiment of the union element.

Figure 15:
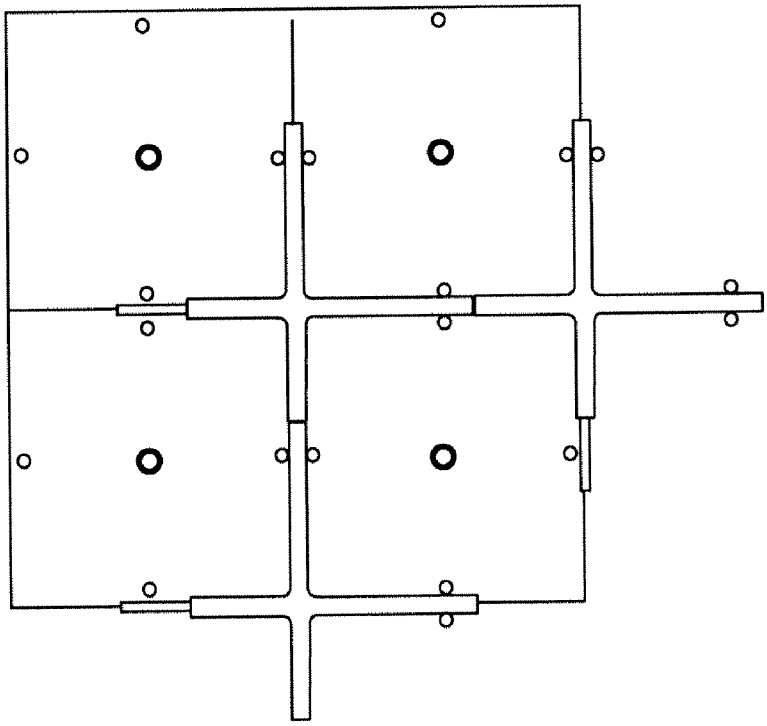

FIG. 15 is a schematic lower plane view of a section of the assembled floor, showing several floor modules and union elements in its position of use.

DETAILED DESCRIPTION OF THE INVENTION

The following description will be referred to the accompanying drawings before described that must be understood as illustrative of the preferred embodiments of the invention, and non-limiting of the scope of the inventive concept. The common elements in the figures have the same numerical references in all of them.

The present invention refers to a system that allows the assembling of individual floor modules to form a floor or platform that can be placed on the ground or another floor used as a base, so that a new surface is offered on which a user can freely walk or which can serve as a support base for a load. One of the immediate applications of the invention is in the construction of floors or platforms with electricity insulating properties to allow a person to accede to areas whose conditions, as the conductive water presence or other elements in the ground, could put it in risk of an electrical shock.

For the accomplishment of the invention, it is considered that two elements are fundamental:

a) Floor modules, and b) Union elements for the floor modules

The construction material for both classes of modules can be a plastic resin such as ABS or high density polyethene (HDPE), which allows to use the modules of the invention to assemble an electrically insulating floor or platform.

The floor modules consist essentially of hollow prismatic pieces with low height, in the order of a few centimeters; the prismatic body includes:

a) A first upper base, its outer face offering the useful surface for the support of load or people;

b) Vertical rectangular walls, towards underneath the upper base along its perimeter and forming the prismatic body; and c) A second base, opposed to the first upper base, which limits to a frame defined by the lower edges of the vertical walls.

Figure 1:
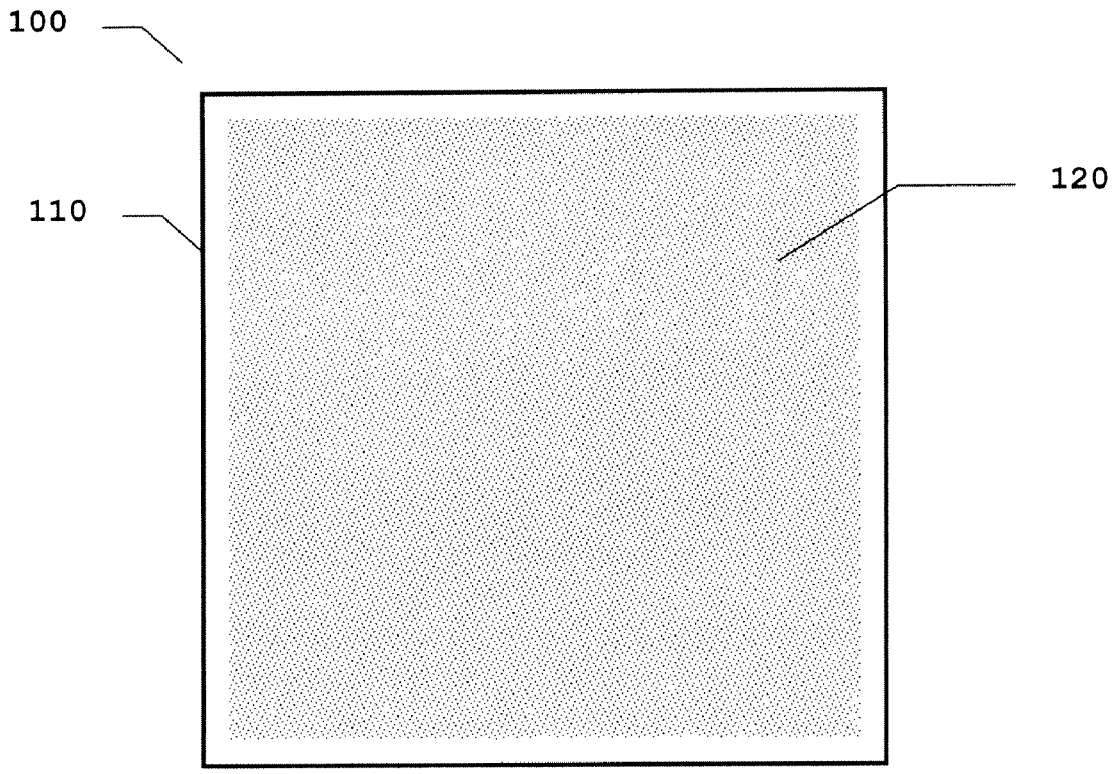
FIG. 1 is an upper plane view of a modular floor element of the invention.

In reference to FIG. 1, the floor module (100) has a square-based prism shape, whose upper face (110), in a preferred embodiment, can have a non-slippery surface (120) which can be the textured surface of the manufacture material of the floor module (100) or a non-slippery material applied on the upper face (110).

Figure 2:
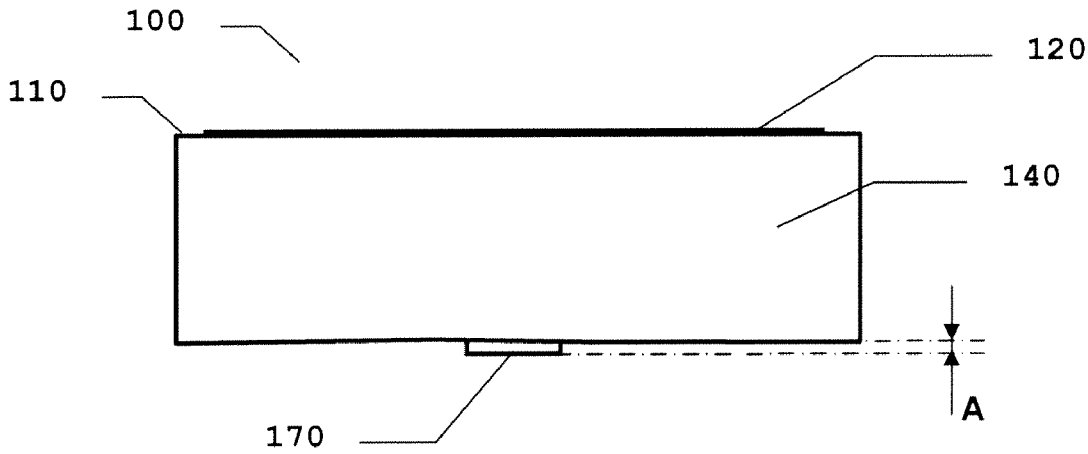
FIG. 2 is a lateral plane view of a modular floor element of the invention.
Figure 3:
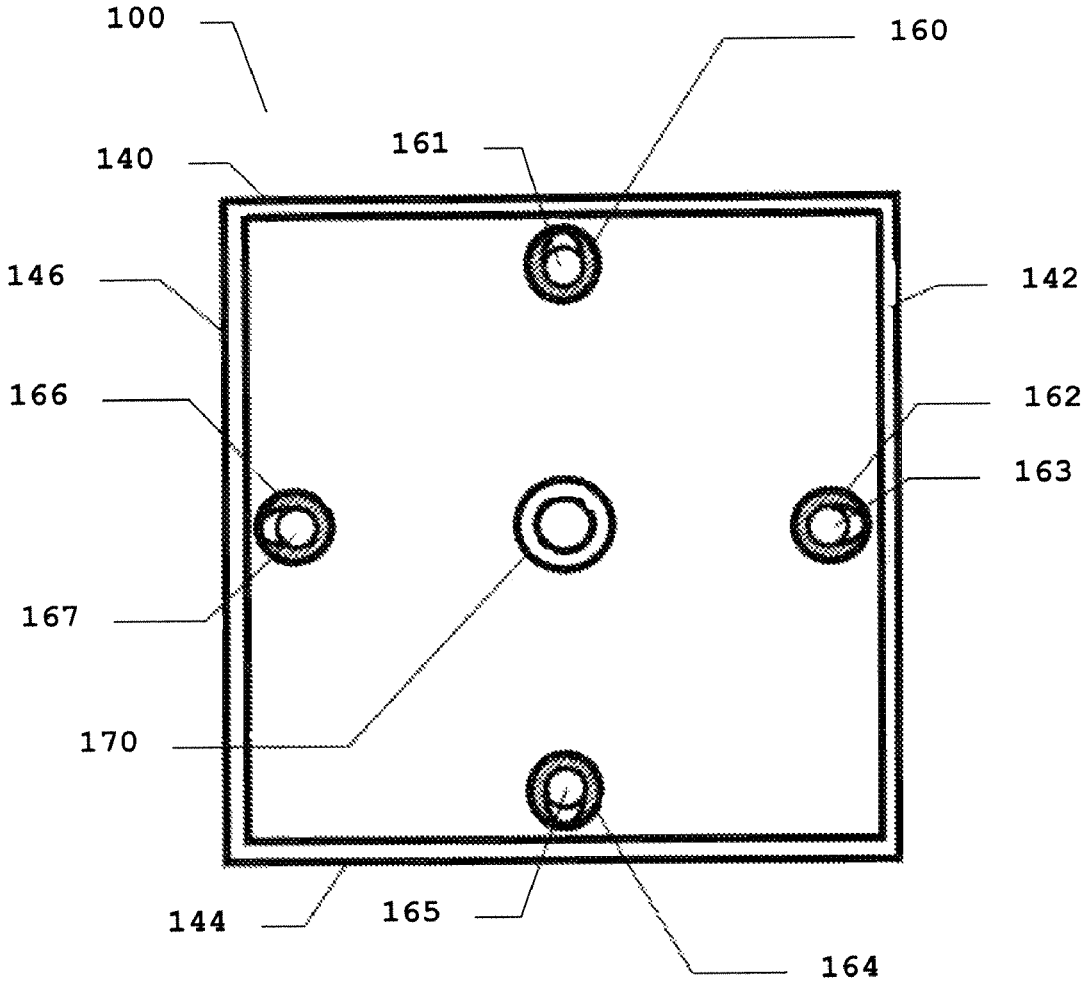
FIG. 3 is a lower plane view of a modular floor element of the invention.
Figure 4:
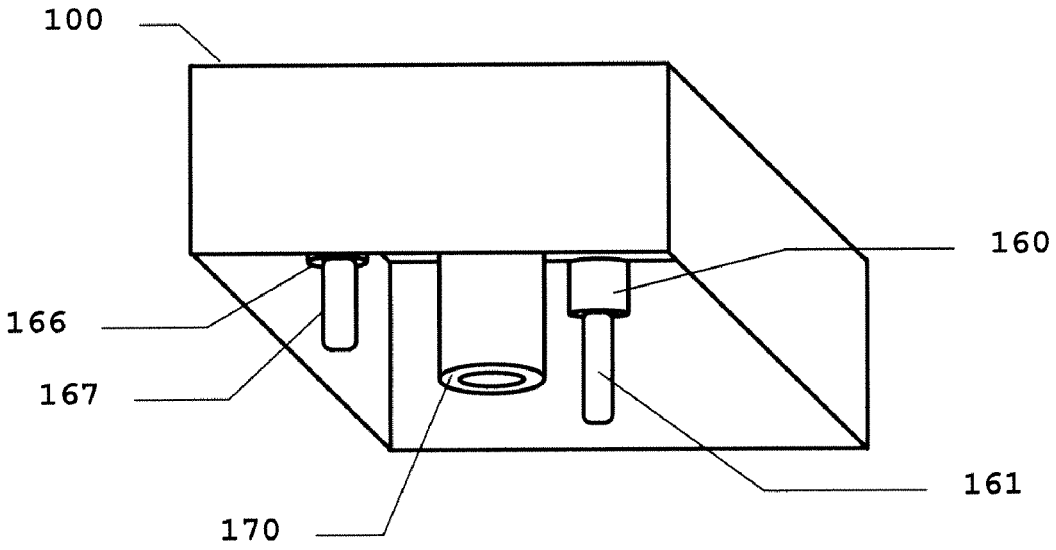
FIG. 4 is a simple perspective view of a modular floor element of the invention, from a point below its lower plane.

The floor module (100) have essentially rectangular vertical walls (140), as shown in FIG. 2; at the interior of the floor module (100), illustrated in FIG. 3, a plurality of cylindrical elements is observed (160), (162), (164), (166), that project vertically, located close to the peripheral vertical walls (140), (142), (144) and (146) respectively, and preferably in the mean zone of each one of these walls. It is observed in the FIG. 3 that the cylindrical bodies (160), (162), (164), (166), are formed by two sections, being one of them (shown shaded) of a diameter greater and the other (without shaded, designated by (161), (163), (165) and (168)) of a smaller diameter, located to the end of the bodies, this being appreciated better in the perspective view in FIG. 4 for the elements (160) and (166), designating to the end zones with the references (161) and (167) respectively.

Figure 5:
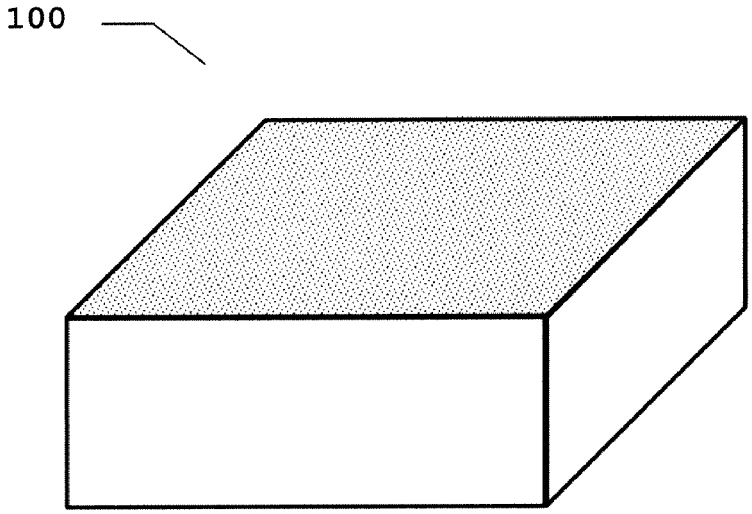
FIG. 5 is a simple perspective view of a modular floor element of the invention, from a point over its upper plane.

Inside the floor module (100) another cylindrical body (170) is located, preferably hollow, that extends vertically aligned with the central axis of the prism, from the inner surface of the useful face (110) towards the lower plane of the prism, protruding slightly as it is observed in the lateral view of FIG. 2, being "A" the measurement of this protruding as defined ahead, becoming a load post to directly transmit any weight on the useful surface (110) to the ground on which this individual module rests (100). The module (100) thus described could offer a perspective view like that in FIGS. 4 and 5.

Figure 6:
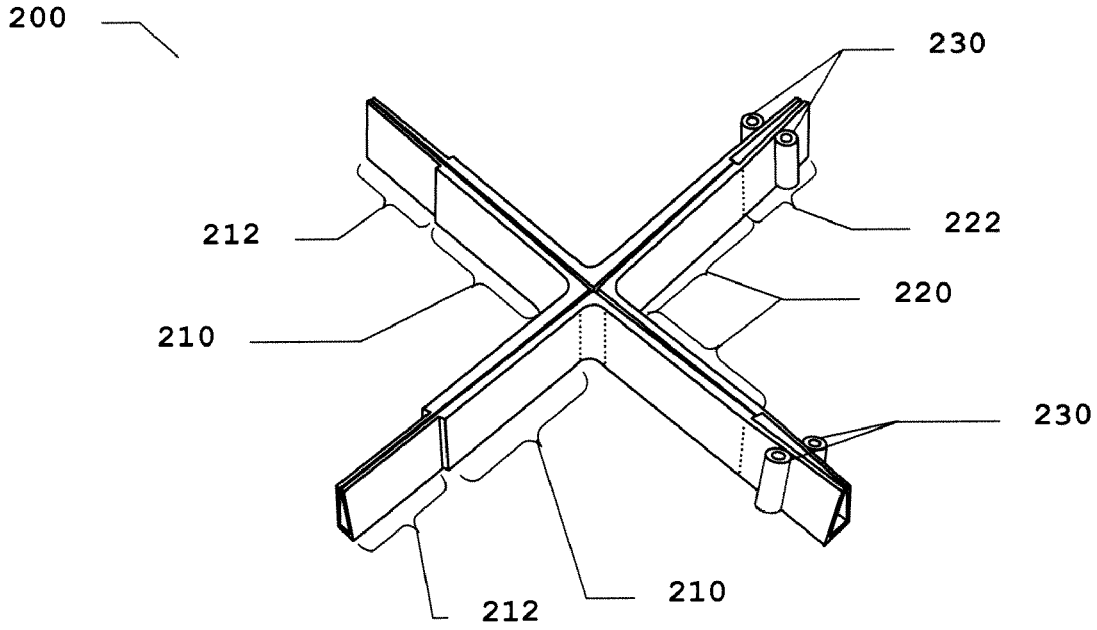
FIG. 6 is a perspective view over the upper plane of a union element of modular floor element of the invention.
Figure 7:
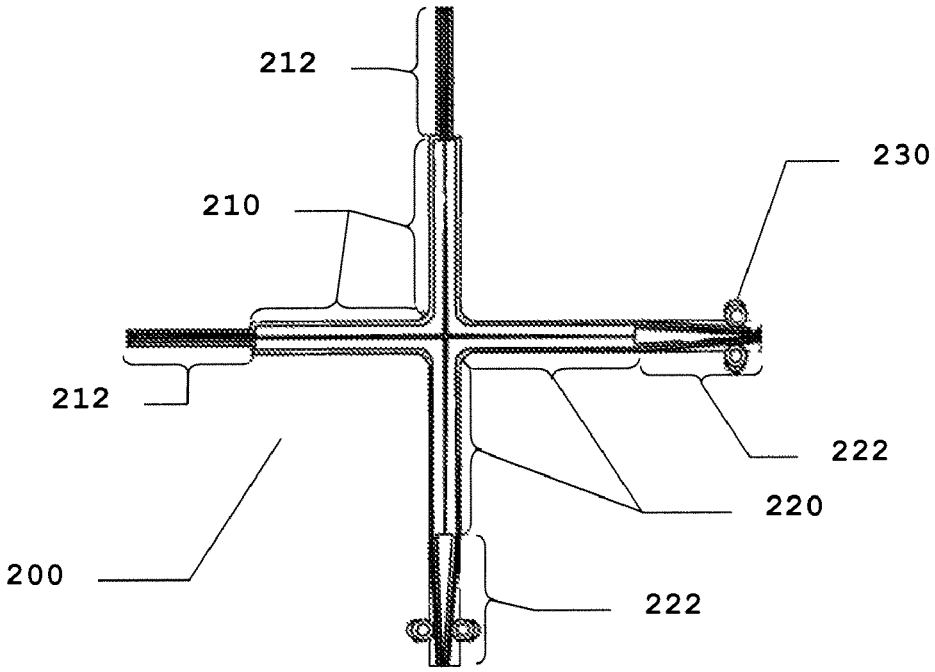
FIG. 7 is a upper plane view of a union element of modular floor elements of the invention.
Figure 8:
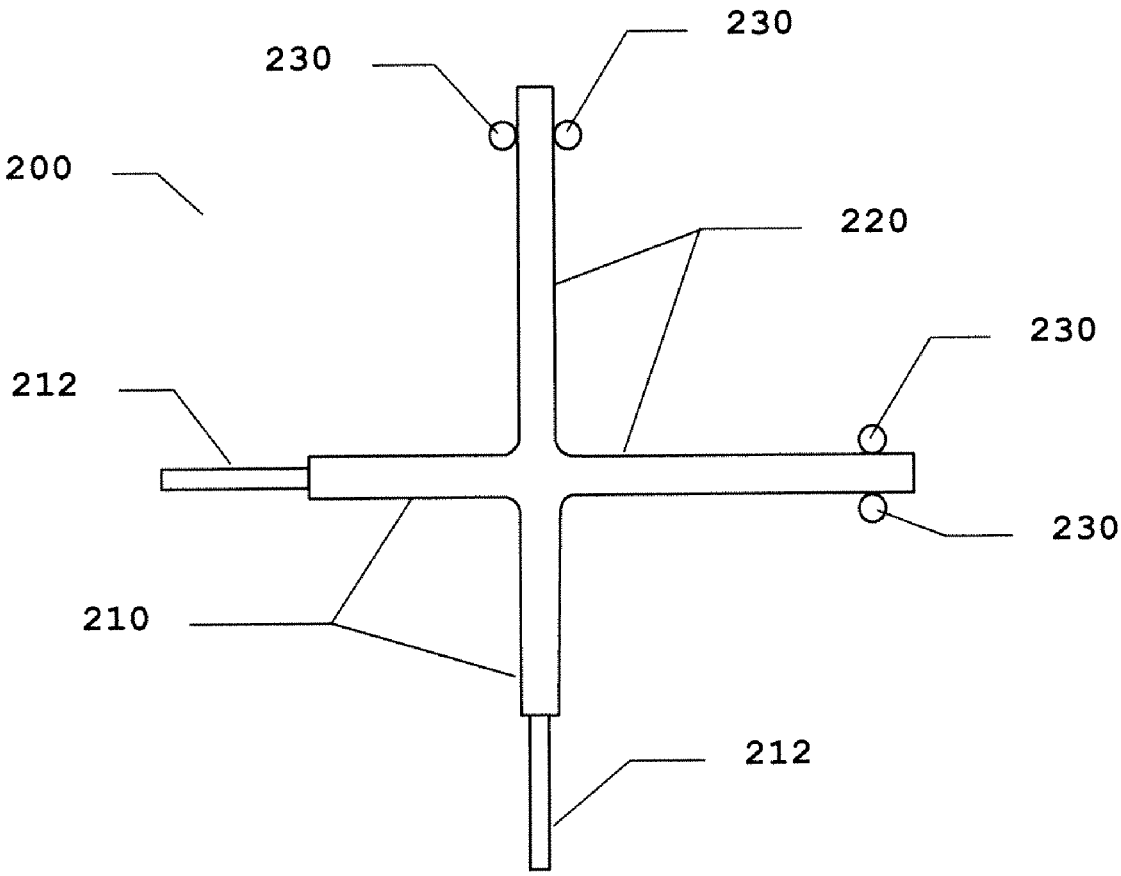
FIG. 8 is a lower plane view of a union element of modular floor elements of the invention.
Figure 9:
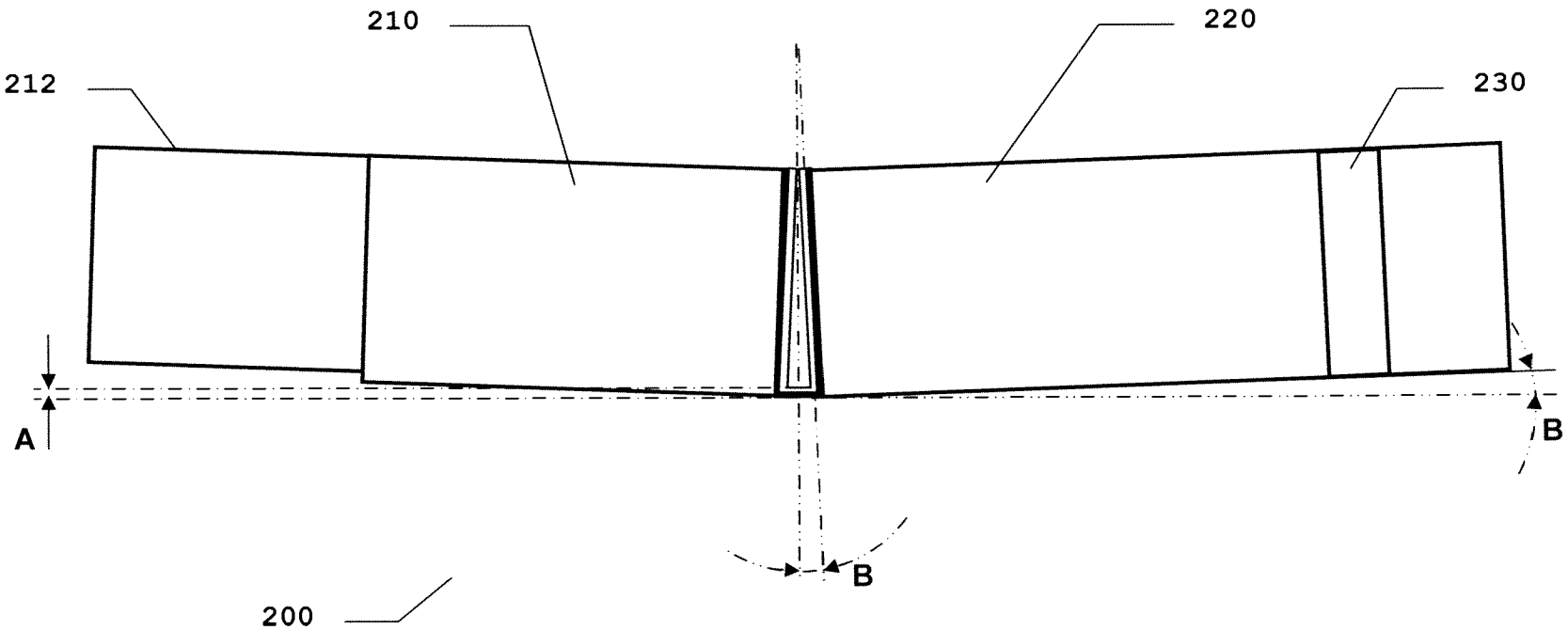
FIG. 9 is a frontal plane view of a union element of modular floor elements of the invention.

In FIGS. 6 to 9 a preferred embodiment of the union elements (200) to coupling floor modules (100), is shown, being FIG. 6 a perspective view over the upper plane, FIG. 7 an upper view, FIG. 8 a lower view and FIG. 9 a front/rear view, showing that the union elements (200) consist essentially of a cross-shaped base whose arms have a "U"-shaped cross-section, having the open ends of the "U" closer to each other than in the base, to allow the entrance of the vertical faces of floor modules.

Two of the contiguous arms, show a zone close to the crossing between arms (the center of the union element) with a constant thickness (210), and one zone close to the end of these arms with a recess (212) in their surface, so that these walls approximately have a thickness of half of the thickness of the zone (210). The other two arms opposed to the first two, show a zone close to the crossing between arms (the center of the union element) with a constant thickness (220), and one zone close to the end of these arms with a recess (222) in the internal surface of the vertical faces, so that these walls have a thickness of approximately half of the thickness of the zone (220). The length of the recesses in the arms is the same, so that they correspond to each other and when inserting an arm with outer recess through the arms of an arm with inner recess, the thickness of the faces of both arms is equaled to the one of the zones without recess.

The arms with inner recess have a pair of cylindrical posts (230), located on their outer surface and located to a distance from the center of the element of union equal to the half of the length of a face of a floor module; these cylindrical posts are hollow and will serve as subjection elements of the corresponding floor module, as it is described ahead.

The material of manufacture of the union elements (200) is a synthetic resin with insulating properties.

In FIG. 9, details of the design of the union elements that are important for their function are shown. It is observed that the thickness of the walls and base of the union element (200), in the zones without recesses, has a measurement "A" that it is also the thickness of the combined walls when two union elements (200) are overlapped in its position of use when coupling two floor modules, and is this measurement "A" indeed the one that corresponds to the protrusion indicated in FIG. 2 for the central cylindrical post (170) of the floor module, so that the same level in the complete useful surface is guaranteed, when each floor module is assembled with other modules.

Also it is appreciable in the FIG. 9 that the base of the union element (200) is not completely straight in all their length, showing an angle "B" of inclination in both arms equal to angle "B" of inclination of the vertical walls of the arms with respect to the vertical; if it is considered that the space between the vertical walls of the arms measured in the interior in the tie point with the base of the union element (200) is equal to the double of the thickness of the faces of the floor modules (100), when two faces of two floor modules are inserted (100) to coupling, the ends of the "U" of the arm that is used to maintain these floor modules united (100) are opened until the faces of the arm remain vertical and parallel each other, forcing then to the perpendicular arms to a horizontal position; the "memory" of the material, nevertheless, produces that the arms of the union element exert a constant pressure on the interior of the faces of the floor modules (100) in their interior, assuring them in its site.

Figure 10:
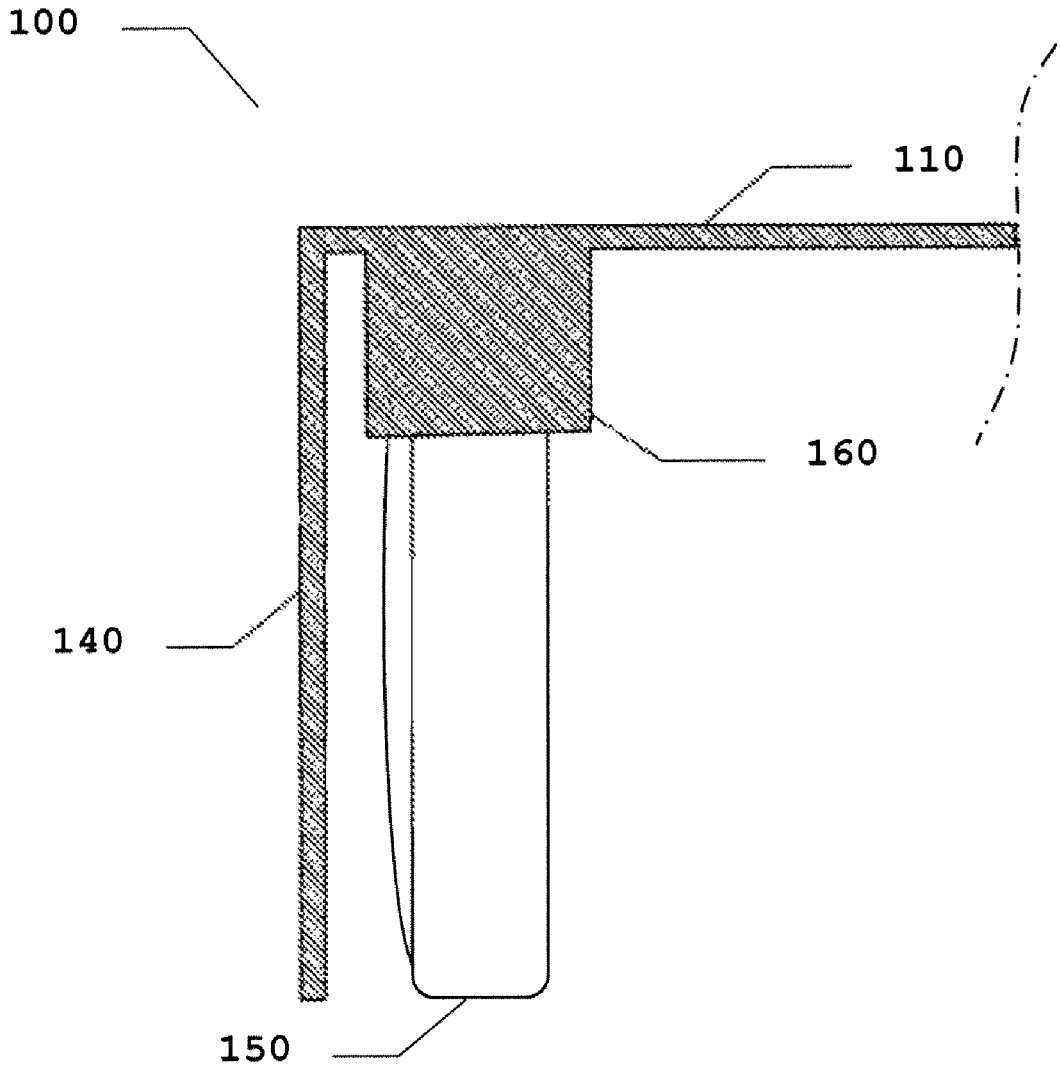
FIG. 10 is a cross-sectional view of a modular floor element of the invention, throughout the mean line of this element, in a zone close to one of the sidewalls.

For a better understanding of the way in which the union elements (200) operate, in FIG. 10 is a detail of a cross-sectional of a floor module (100), throughout its central plane, so that it is clearly observed that the cylinder (160), taken as example for the other cylinders, it is placed closely to the inner surface of the vertical wall (140), this cylinder (160) forms a single body with the upper base (110) of the module (100), extending downwards until a distance such as the lower edge of this cylinder (160) coincides with the upper edge of the cylindrical and hollow subjection element (230) in the vertical wall of one of the arms with inner recess of the union element (200), as described ahead. The cylinder (160), as already it has been indicated, continues with a smaller diameter throughout the zone (161) that extends until reaching the level of the edge of the vertical face (140) of the floor module (100); this cylinder (161) has a diameter such as allows its sliding in the hollow of vertical posts (230) of one of the union elements.

In the sectional view illustrated in FIG. 10 a projection (150) in the cylinder (161) is observed, with a rounded section, as shown in the lower view of the floor module (100) in FIG. 3; the function of this projection is to slightly extend (the illustration shows this projection exaggerated) the diameter of the cylinder (161), so that the pressure against the walls of the cylindrical subjection element (230) of the union element (200) is increased, especially in the direction towards the wall (140) of the floor module (100) also in order to increase the pressure that exerts the body of the subjection element (230) on the vertical wall of the arm of the union element (200) and as well against the walls of the floor modules (100) inserted in this arm.

Figure 11:
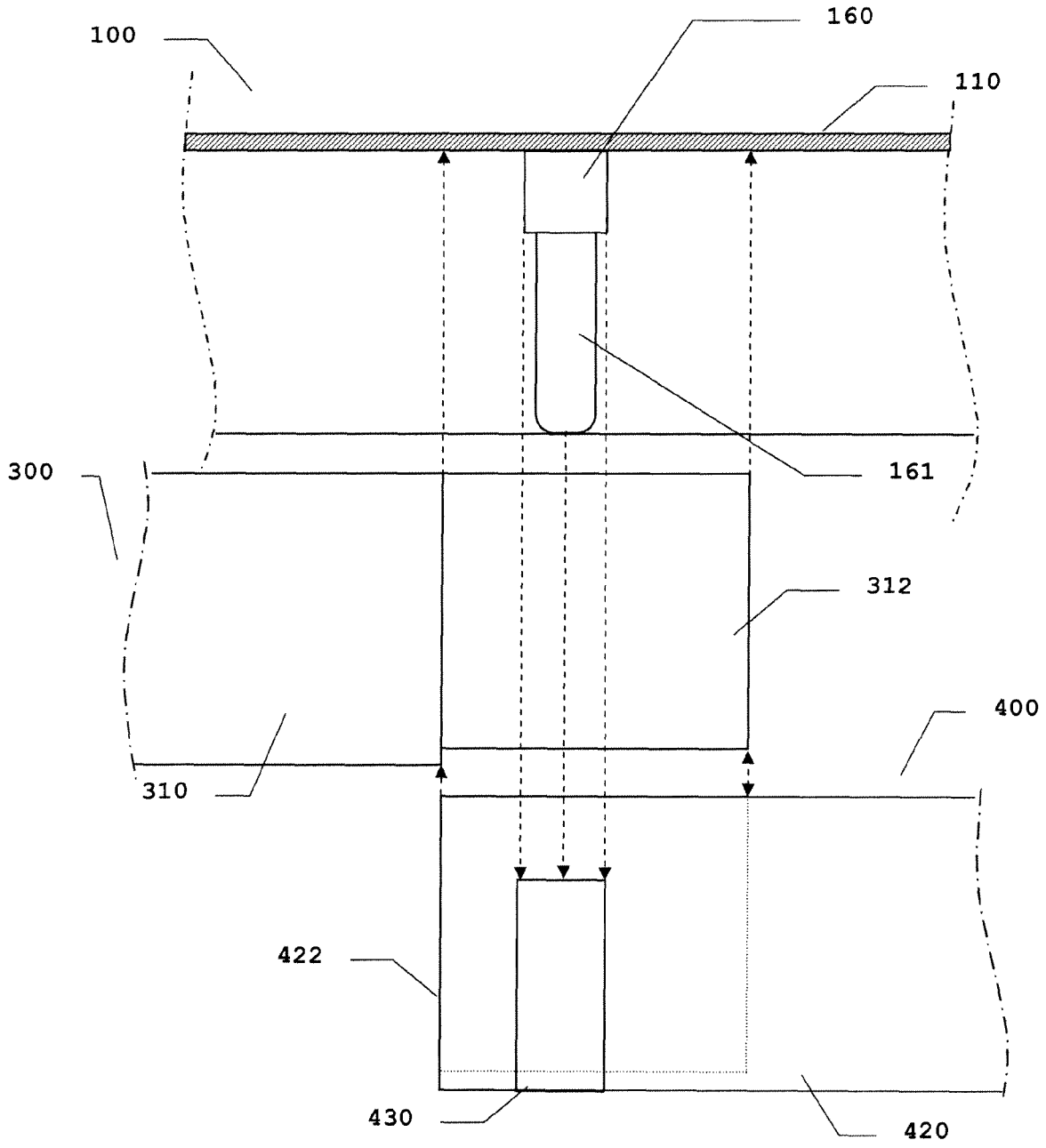
FIG. 11 is a schematic view of the process of connection of two union elements with a modular floor element of the invention.
Figure 12:
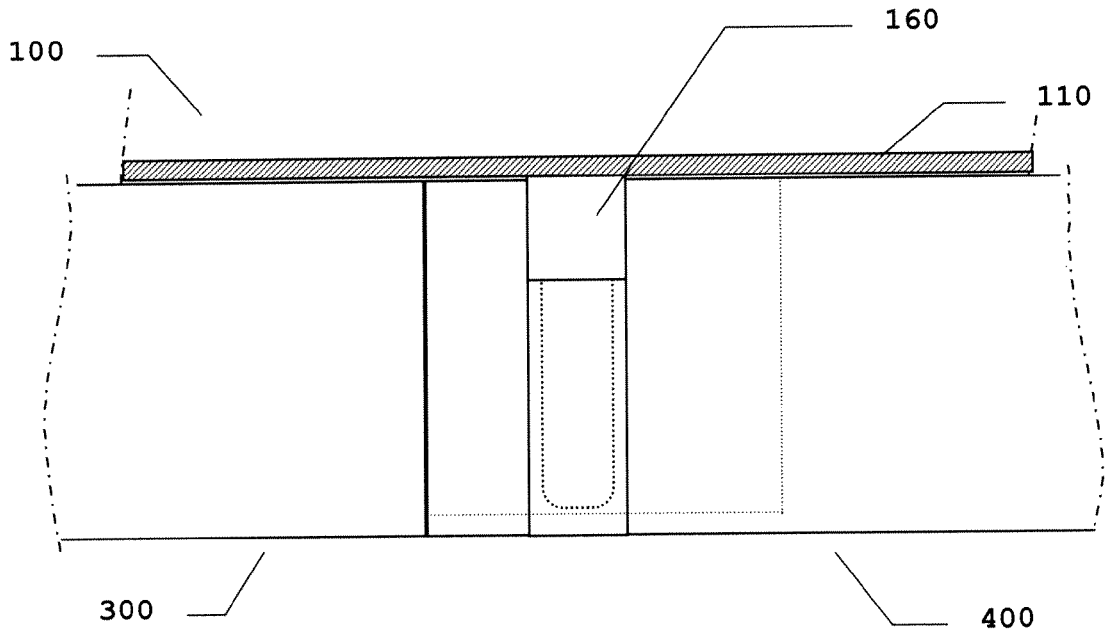
FIG. 12 is a schematic of a cross-sectional view of the connection between two union elements and a modular floor element to produce the floor of the invention.
Figure 13:
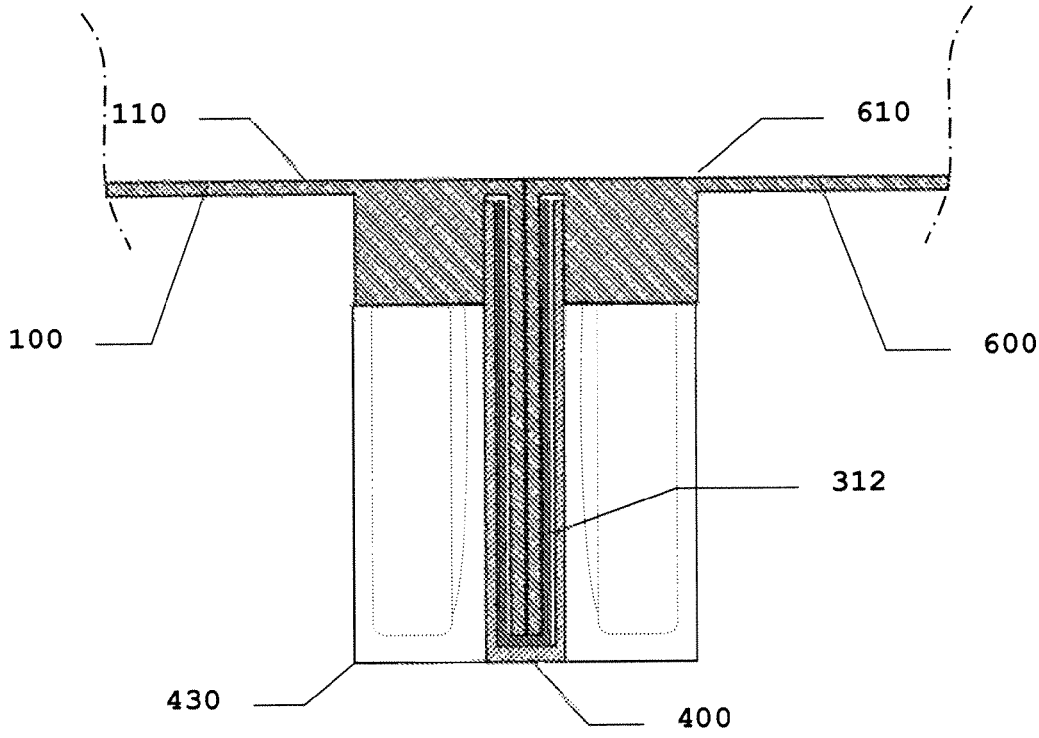
FIG. 13 is a schematic of a cross-sectional view of the connection between two modular floor elements and a union element to produce the floor of the invention.

The union elements (200) have an overall height such that can be placed perfectly below the floor modules (100), so that, as it is schematically shown in FIGS. 11, 12 and 13, for the vertical cylindrical post (161), this one can slide fittingly to the interior of the hollow cylindrical element referred as (430) for the arm of a union element (400) (by analogy with a union element (200), the constituent elements of other union elements (300) and (400) are designated with the same final digits, changing first digit "2" by "3" and "4", respectively), where the section (420) of this arm (400) "surrounds" to the zone with recess (312) in the end of the arm of a union element (300), where the outer recess (312) occupies the zone of the inner recess (420) of the arm of the union element (400) (indicated in dotted lines); the three bodies move in the sense indicated by the dotted arrows in FIG. 11 to occupy the sites illustrated in FIG. 12.

FIG. 13 schematically illustrates the position of the diverse elements involved in the union of two floor modules (100) and (600), by means of the union elements (300) and (400) illustrated in FIGS. 11 and 12.

Figure 14A:
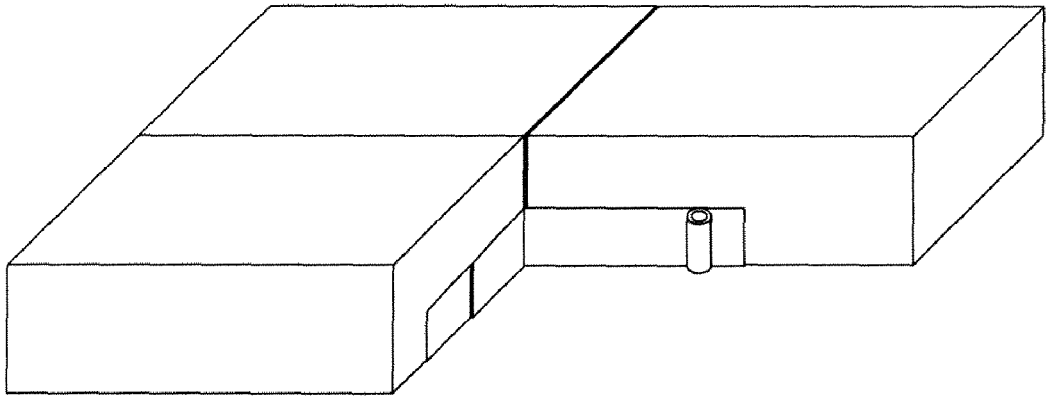
FIG. 14 *a* is a simple perspective view of a section of the assembled floor using a medium height embodiment of the union element.
Figure 14B:
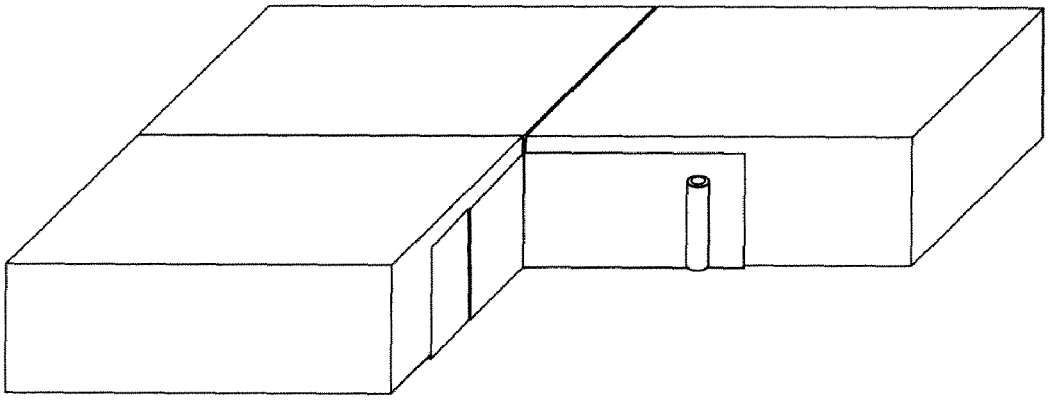
Figure 14C:
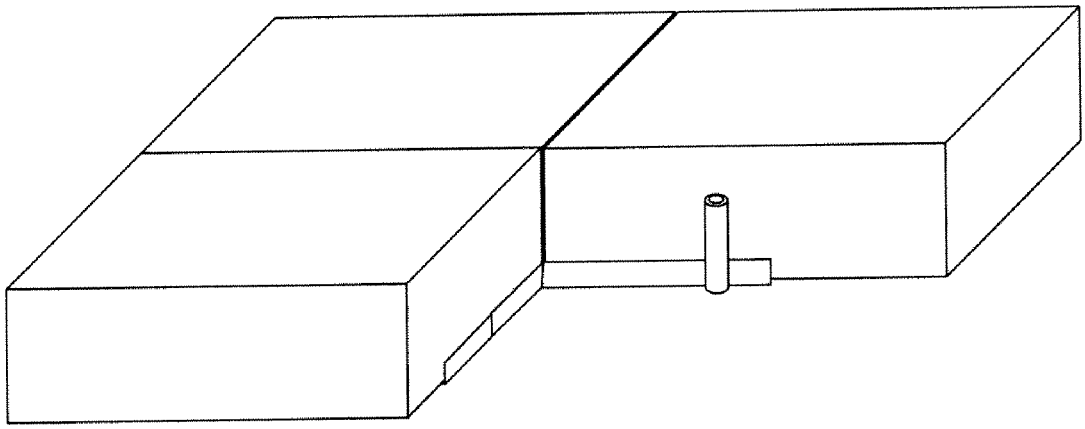

In FIGS. 11 to 14*a-c* it is possible to appreciate that the subjection elements (430) not necessarily have the same height that the walls of the arms of the union elements (300) and (400) as shown previously for the union element (200), The walls can be as small as to allow the union of the bases of two floor modules, as shown in FIG. 14*c*, or to cover the space available inside the floor module (100), (600), so that they reach the lower face of the upper base that has the useful surface (110) (and (610) by analogy), as shown in FIGS. 13 and 14*b*. On the other hand, FIG. 14*a* illustrates a medium height of the walls of the arms of the subjection element, as shown in the figures that refer the union element (200).

The embodiment illustrated in FIGS. 13 and 14*b* represents the preferred embodiment of the invention, since it offers the greater physical stability for the assembled set, diminishes to a minimum the possibility that a space between the vertical walls of two floor modules (100), (600) united by a union element (200) be opened, and they offer the greater possible trajectory for a possible current discharge from the useful surface towards the ground or vice versa, forming a labyrinth difficult to surpass by an electrical charge, and so it also maximizes the efficiency of the isolation and the protection to the user.

In the illustrated preferred embodiment in sectional view in FIG. 13, it is observed that the walls of the zone with outer recess (312) become vertical and are parallel to each other, as they are the walls of the section with inner recess (422); it is observed also that the projections throughout the cylindrical elements of the floor module that are inserted in the fixation elements (430) are completely inserted and offer pressure on the walls of the subjection elements (430) and from here to the walls of the union elements (312) and (422) and so the vertical walls of the floor modules (100) and (600) are firmly fixed in position, so close to each other as allows the roughness of the material.

In order to form an assemblable floor of the appropriate dimensions to cover the wished area, so many floor modules are united to each other as they are necessary, connecting pairs of floor modules using so many union elements of pairs of modules as it is required, as it is shown in FIG. 15 for a rectangular section of assembled floor. Observe that whenever it is had a new union element surrounding with his arm with inner recess to the outer recess of another already placed, the cylindrical elements are located on position to receive the cylinders of the floor module and their arms with outer recesses are ready for the following union element available; also it is observed in this figure that once united the union elements to each other, a sustentation base is made for the set with an area of constant width right under the vertical walls of the floor modules, which represents a minimal area of contact with the floor on which the assembled will rest.

It could be observed that the floor assembled obtained, rests on the ground and its stability with respect to the same will depend basically on the weight of the floor as a whole and of the load on the same. In this sense it is very useful that the floor module is hollow at its lower face, since this way the contact surface is diminished, increasing the possibility that the assembled floor adapts to the irregularities of the ground maintaining a high stability and lifting capacity.

It should be observed that because the geometrical configuration of the modules and the union elements, all strength on the assemblable floor it is transmitted to the lower floor through the vertical walls, the prismatic body of the union elements and the central cylindrical load body, and so a high stability of the assemblable floor is obtained.

It will be observed that the modules that conform the system of the present invention are not connected in a permanent way, reason why it is possible to disassembling all the set and to reuse the pieces to form a new floor.

Considering the previous, it will be evident for a person with knowledge in the technical field that some modifications to the basic configuration of these illustrated modalities can be necessary to satisfy particular requirements but it will have to be considered that these modifications will not take to the invention thus described beyond the scope of the following claims.

Once described the invention, which is considered novel and therefore its property it is claimed, is:

1. An interlocking floor assembly comprising:

a plurality of floor modules, each floor module having a square floor surface and four rectangular, vertical walls projecting downward from the bottom of said floor surface, the floor surface and vertical walls arranged to form a right rectangular-sided prism with an open base, each floor module including a hollow cylindrical load member that extends downward from the center of the floor surface and a plurality of cylindrical projections that extend downward from the bottom of the floor surface, the plurality of cylindrical projections positioned on a plurality of line segments running from the center of the floor surface to a mid-point of the edges of the square floor surface, with a first section of each cylindrical projection and a second section of each cylindrical projection having a greater diameter than the first section;

a plurality of floor connectors, each floor connector having four perpendicular arms arranged in an X-shape, with each arm having a base and two walls forming a U-shaped cross section, the arms adapted to receive and retain the vertical walls of the floor modules, the walls of each arm being turned slightly inward to form an opening that is narrower at the top of each arm than at the bottom, a first pair of the perpendicular arms each having a recessed distal section on the exterior wall and base surfaces of the arm, and a second pair of the perpendicular arms each having a recessed distal section on the interior wall and base surfaces of the arm, the second pair of perpendicular arms each comprising a pair of cylindrical sleeves located on the exterior wall surfaces of the arm;

wherein the distal section of the second pair of perpendicular arms of each floor connector is adapted to receive the distal section of the first pair of perpendicular arms of an adjacent floor connector, and, when the first and second pairs of arms are engaged the distance between adjacent floor connectors is about the length of a side of the floor surface; and wherein the cylindrical sleeves of the floor connectors are adapted to engage the cylindrical projections of the floor modules, with the first section of the cylindrical projections adapted to be inserted into the cylindrical sleeves and the second section of the cylindrical projections adapted to rest on a top of the cylindrical sleeves.

2. The floor assembly of claim 1, wherein the cylindrical sleeves of the floor connectors have a height such that the first sections of the cylindrical projections can slide completely to the interior of and fit inside the opening of the cylindrical sleeves.

3. The floor assembly of claim 1, wherein the arms of the floor connectors have a height such that the arms reach the bottom of the floor surface of the floor module.

4. The floor assembly of claim 1, wherein the arms of the floor connectors have a minimum height sufficient to hold the bottoms of the floor surfaces of two adjacent floor modules.

5. The floor assembly of claim 1, wherein the arms of the floor connectors have a height smaller than the vertical walls of the floor modules.

6. The floor assembly of claim 1, wherein the distance between the intersection of the arms of the floor connectors and the center of each cylindrical sleeve is about one-half the length of an edge of the floor surface.

7. The floor assembly of claim 1, wherein the lengths of the recessed distal sections in the first and second pairs of the perpendicular arms of the floor connectors are about equal to each other.

8. The floor assembly of claim 1, wherein recessed distal sections in the first and second pairs of the perpendicular arms have a thickness of about half of the thickness of the perpendicular arms without recess, so that when the first and second pairs of the perpendicular arms are engaged the full thickness is about the thickness of the perpendicular arms without recess.

9. The floor assembly of claim 1, wherein a load on the floor surface is transmitted to the an underlying ground surface through the vertical walls of the floor module and the floor connectors, as well as through the cylindrical load member.

10. The floor assembly of claim 1, wherein the floor modules are made of a material with insulating properties, such as a synthetic resin selected of the group that includes ABS and HDPE.

11. The floor assembly of claim 1, wherein the floor connectors are made of a material with insulating properties, such as a synthetic resin selected of the group that includes to ABS and HDPE.

12. The floor assembly of claim 1, wherein said floor modules are textured on the top of the floor surface.

13. The floor assembly of claim 1, wherein said floor modules additionally include the application of non-slip material on the top of the floor surface.

* * * * *